US011241346B1

(12) United States Patent
Haas et al.

(10) Patent No.: US 11,241,346 B1
(45) Date of Patent: Feb. 8, 2022

(54) PORTABLE BODY POSITIONING BED FRAME ASSEMBLY

(71) Applicants: Albert F. Haas, Mobile, AL (US); Kenneth E. Francez, Jr., Orange Beach, AL (US); Travis C. Francez, Semmes, AL (US)

(72) Inventors: Albert F. Haas, Mobile, AL (US); Kenneth E. Francez, Jr., Orange Beach, AL (US); Travis C. Francez, Semmes, AL (US)

( * ) Notice: Subject to any disclaimer, the term of this patent is extended or adjusted under 35 U.S.C. 154(b) by 102 days.

(21) Appl. No.: 15/614,886

(22) Filed: Jun. 6, 2017

Related U.S. Application Data

(60) Provisional application No. 62/346,652, filed on Jun. 7, 2016.

(51) Int. Cl.

| | |
|---|---|
| ***A61G 7/015*** | (2006.01) |
| ***A61G 7/075*** | (2006.01) |
| ***A61G 7/07*** | (2006.01) |
| ***A61G 7/018*** | (2006.01) |

(52) U.S. Cl.
CPC ..... *A61G 7/015* (2013.01); *A61G 7/018* (2013.01); *A61G 7/07* (2013.01); *A61G 7/0755* (2013.01)

(58) Field of Classification Search
CPC ..... A61G 7/015; A61G 7/018; A61G 7/07; A61G 7/0755; A61G 5/0866; A61G 5/1075; A61G 5/122; A47C 19/045
USPC ..... 5/617
See application file for complete search history.

(56) References Cited

U.S. PATENT DOCUMENTS 1,075,752 A * 10/1913 Bartholme ..... A61G 7/015 5/618
2,834,032 A * 5/1958 Scott ..... A47C 20/021 297/377
3,636,573 A * 1/1972 Bartz ..... A61G 7/015 5/618
4,361,917 A * 12/1982 Wilson ..... A47C 20/041 5/616
5,230,113 A * 7/1993 Foster ..... A61G 5/14 5/604

(Continued)

FOREIGN PATENT DOCUMENTS

WO 2009108537 A1 9/2009

*Primary Examiner* — Peter M. Cuomo
*Assistant Examiner* — Myles A Throop
(74) *Attorney, Agent, or Firm* — Adams IP, LLC; Edward B. Garner, III; James Hunter Adams

(57) ABSTRACT

A portable body positioning bed frame assembly having a first frame support reversibly attached to a second frame support. The first frame support has a back frame attached rotatably thereto and the second frame support has a thigh frame attached rotatably thereto, with a linear actuator attached between the second frame support and the thigh frame. A calf frame is attached rotatably to the thigh frame. The linear actuator raises and lowers the thigh frame and the calf frame. The calf frame is hinged to the thigh frame to maintain the calf frame approximately parallel to the second frame support as the thigh frame and calf frame are raised and lowered by the linear actuator. The back frame has a support bar for raising and lowering the back frame and adjustable curvilinear back supports for an adjustable convexity in the back of a user that will maintain the shoulders in an anterior position.

13 Claims, 3 Drawing Sheets

(56) References Cited

U.S. PATENT DOCUMENTS

| | | | | |
|---|---|---|---|---|
| 6,061,852 | A * | 5/2000 | Bathrick | A47C 20/041 5/400 |
| 6,219,863 | B1 * | 4/2001 | Loberg | A47C 19/005 5/200.1 |
| 6,640,365 | B1 | 11/2003 | Chang | |
| 6,687,932 | B1 * | 2/2004 | Bangert | A47C 20/041 5/617 |
| 7,530,125 | B2 * | 5/2009 | Neuenswander | A47C 20/041 5/616 |
| 7,930,780 | B2 | 4/2011 | Clenet | |
| 8,713,729 | B2 | 5/2014 | Malakhov | |
| 9,049,942 | B2 | 6/2015 | Huang | |
| 9,737,150 | B2 * | 8/2017 | Rawls-Meehan | A47C 20/041 |
| 2002/0144350 | A1 * | 10/2002 | Shih | A47C 20/041 5/620 |
| 2006/0085913 | A1 | 4/2006 | Kawakami et al. | |
| 2009/0089930 | A1 * | 4/2009 | Benzo | A61G 7/015 5/613 |
| 2010/0037397 | A1 | 2/2010 | Wood | |
| 2010/0275376 | A1 * | 11/2010 | Benzo | A61G 7/0573 5/618 |
| 2011/0101749 | A1 | 5/2011 | Shih | |
| 2014/0075674 | A1 * | 3/2014 | Chun | A61G 7/018 5/618 |
| 2015/0250323 | A1 * | 9/2015 | Goldsmith | A47C 19/045 5/11 |

* cited by examiner

PORTABLE BODY POSITIONING BED FRAME ASSEMBLY

CROSS-REFERENCE TO RELATED APPLICATIONS

This application claims priority to U.S. Provisional Patent Application No. 62/346,652, filed Jun. 7, 2016, the disclosure of which is incorporated herein by reference.

FIELD OF THE INVENTION

The present invention is directed to devices and systems for supporting the body of a user. In particular, the present invention is useful for supporting a user during sleep, elevating the user's torso, and allowing for an adjustable convexity in the back that will maintain the shoulders in an anterior position after surgical procedures.

BACKGROUND OF THE INVENTION

There are 400,000 rotator cuff surgeries performed each year in the United States and an additional 200,000 non-rotator cuff shoulder surgeries performed each year. The vast majority of patients have impaired sleep related to the pain associated with the swelling and inflammation that invariably accompanies these procedures. Typically, this pain is worsened in the supine position and greatly improved with elevation of the torso typically 30 degrees or more. Common treatments such as ice packs and narcotics are insufficient in relieving the pain adequately to achieve the optimum levels of rest and sleep that are vital to post-operative recovery. Tens of thousands of patients resort to sleeping in a recliner or propped on a couch or pillows, often for weeks, which is both uncomfortable and not ideal for proper shoulder positioning.

Shoulder pain is prevalent among people of advanced age and those who suffer from rheumatoid arthritis, spinal cord injury, stroke, and Parkinson's disease. An important detail that distinguishes shoulder pain from other forms of musculoskeletal pain is the prevalence of sleep related symptoms. Clinical studies have shown that nocturnal pain, insomnia, and inability to sleep on the affected side are prominent features of shoulder pain.

Many shoulder pain sufferers find sleeping on the side painful. The intense pressure exacerbates shoulder pain, interferes with sleep, and can lead to soreness in the neck and arm, as well as numbness in the involved extremity. Some shoulder pain sufferers resort to sleeping on their backs, and, as a consequence, experience apnea. For many snorers, both non-obstructive and obstructive sleep apnea is position-specific and occurs while sleeping on the back. Sleeping in a semi-seated position or in a lateral decubitus position prevents snoring for these patients and both simple and complex methods to prevent back sleeping are recommended. Those who sleep on their sides often experience chronic neck and back pain due to spinal misalignment.

U.S. Pat. No. 8,713,729 discloses a device for supporting a user which includes a frame for supporting the torso of the user. The frame may be oriented in left, middle and right orientations. The user's arms extend through openings, which permit the user to position the arm adjacent the frame without the user's body weight on the user's shoulder or arm. Considerable structural complexity is required to rotate the device clockwise and counterclockwise with a motor and shaft. Consequently, the device is not portable. Furthermore, one of the arms must hang down which can be uncomfortable and, in some cases, produce edema in the hands and wrists.

Accordingly, what is needed is a bed positioning system that allows the user to remain on his or her back with the torso elevated and without stressing the shoulders.

SUMMARY OF THE INVENTION

The invention is a portable body positioning bed frame assembly having a first frame support reversibly attached to a second frame support. The first frame support has a back frame attached rotatably thereto and the second frame support has a thigh frame attached rotatably thereto. A linear actuator is attached between the second frame support and the thigh frame. A calf frame is attached to the thigh frame. The linear actuator is constructed to raise and lower the thigh frame and the calf frame. The calf frame is hinged to the thigh frame to maintain the calf frame approximately parallel to the second frame support as the thigh frame and the calf frame are raised and lowered by the linear actuator. The back frame has a support bar for raising and lowering the back frame. The back frame also has a head support and adjustable curvilinear back supports.

The first frame support has a first end and a second opposite end and the second frame support has a first end and a second opposite end. The first end of the first frame support has a support member for the back frame to raise and lower the back frame and the second opposite end of the first frame support has extensions. The first end of the second frame support has connectors to reversibly engage the extensions, thereby forming the portable body positioning bed frame assembly. The second opposite end of the second frame support is connected to the linear actuator. The thigh frame has a first end and a second opposite end. The first end of the thigh frame is connected to the second frame support and the second opposite end of the thigh frame is connected to the linear actuator. The calf frame has a first end and a second opposite end and the first end of the calf frame is attached rotatably to the thigh frame. The calf frame also has a heel frame attached at the second opposite end of the calf frame.

An advantage of the portable body positioning bed frame assembly of the present invention is an actuator driven mechanism to raise and lower the legs with angulation at the hips and knees to address swelling in the knees and allow patients to get out of the unit without assistance.

Another advantage is a body positioning bed frame that is light weight, collapsible, easy to carry and transport, and which can be conveniently stored, for example, under a bed.

Another advantage is an adjustable system that flexes the shoulders forward and maintains anterior positioning.

Another advantage is a body positioning bed frame that is adjustable manually or by external controls.

Another advantage is a body positioning bed frame with a back frame that can be positioned horizontally or rotated upward to about 90 degrees.

These and other features of the invention will become apparent from the following detailed description of the invention.

DETAILED DESCRIPTION OF THE INVENTION

Figure 1:
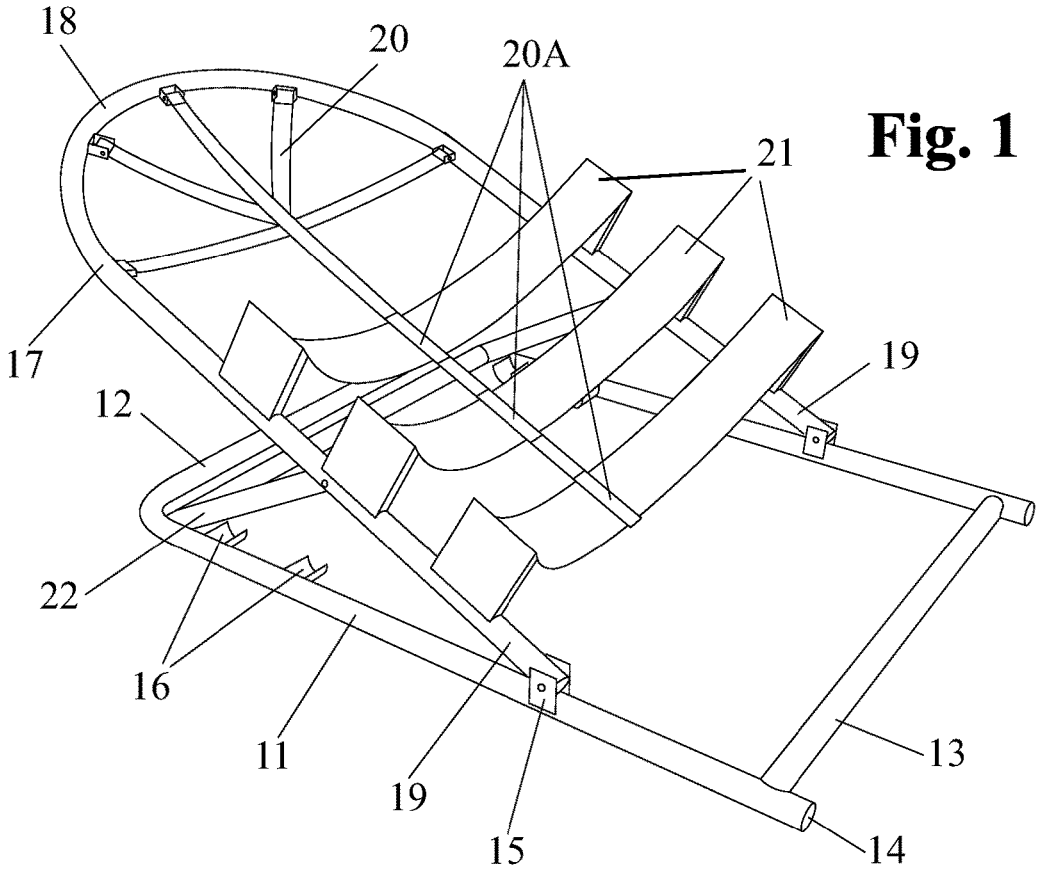
FIG. 1 shows a side perspective view of a first frame support of the portable body positioning bed frame assembly of the present invention.

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

The body positioning bed frame assembly of the present invention comprises a device for positioning the body to facilitate sleep and reduce pain related to, for example, shoulder injuries. The device essentially functions as a bed and has an adjustable upper frame member for positioning the upper body and a lower frame member for positioning the lower body. The body positioning bed frame assembly has a first frame support and second frame support which are reversibly attachable to each other. The device is also portable and the lower portion of the frame can be positioned to elevate the lower extremities to benefit patients with swelling and edema in the lower extremities secondary to surgery, trauma, or medical issues.

This body positioning bed frame assembly is particularly useful for alleviating shoulder pain. However, other conditions, in addition to shoulder injuries and shoulder pain, can benefit from the body positioning bed frame assembly in the promotion of improved sleep, recovery from surgery, and general health. There are 700,000 total knee replacements performed each year in the U.S. After knee replacement surgery patients are told to go home and simply prop up their legs on pillows. The body positioning bed frame assembly would afford independent positioning of the lower extremities when necessary. The device also allows for better upright sleep positioning for patients suffering from sleep apnea, gastroesophageal reflux disease, and orthopnea.

There are 4.5 million patients with obesity related hypoventilation syndrome. The use of CPAP machine for this condition is standard. However, when these patients lie flat, the abdominal organs press on the diaphragm, decreasing breathing excursion, and the soft tissues of the upper airway fall vertically. By elevating the torso and securing positioning of the patients with the body positioning bed frame assembly, the abdominal organs will move caudally and the soft tissues in the upper airway will drop in a tangent leaving a more patent airway in these patients.

Each year 5 million patients suffer with congestive heart failure and 15% to 20% are classified as "end stage." These patients often have fluids that build up during the day, which manifest as edema. These fluids layer out at night causing a condition known as orthopnea. Patients are instructed to prop up on pillows. However, many of these patients often resort to sleeping in recliners. The body positioning bed frame assembly would afford greater sleep comfort with proper torso positioning and security for these patients.

700,000 Americans will suffer a stroke each year, while an additional 4 million individuals will require nursing home care. One-third of all stroke patients will have problems with aspiration, while 20% of nursing home patients will be hospitalized with aspiration pneumonia. The body positioning bed frame assembly will provide significant relief to these patients. Other clinical conditions such as gastroesophageal reflux, head and neck surgery, and plastic surgery recovery may also see significant sleep and rest benefit from the body positioning bed frame assembly.

FIG. 1 shows a rectangular first frame support 11, having a first end 12 and a second opposite end 13. Frame support 11 also has connectors 15 between the first end 12 and the second opposite end 13, slots 16 near the first end 12, and extensions 14 at the second opposite end 13. A U-shaped back frame 17, having a first end 18 and second opposite ends 19, is attached rotatably to the connectors 15 at its opposite ends 19. The back frame 17 is rotatable from 10 degrees to 90 degrees relative to the first frame support 11. The back frame 17 also has a head support 20 and adjustable, curvilinear back supports 21. The curvilinear back supports 21 allow for an adjustable convexity in the back that will maintain the shoulders of a user in an anterior position. A rectangular lift support bar 22 is attached rotatably to the rear of the back frame 17. The support bar 22 can be positioned in the slots 16 to rotate the back frame 17 upward or downward.

Figure 2:
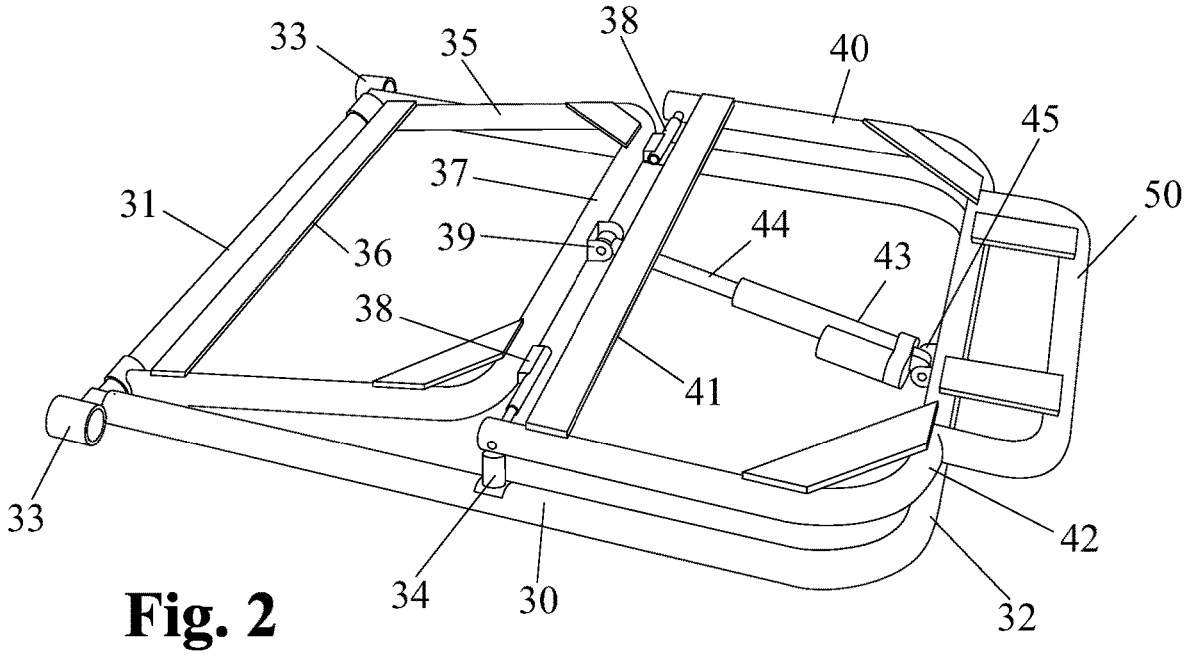
FIG. 2 shows a side perspective view of a second frame support of the portable body positioning bed frame assembly.

FIG. 2 shows a rectangular second support frame 30, having a first end 31 and a second opposite end 32. Connecters 33 at the first end 31 engage extensions 14 on the first support frame 11 to reversibly connect the first support frame 11 to the second support frame 30. The second support frame 30 also has a calf frame support 34 and a connector 45 is positioned on the second opposite end 32. A rectangular thigh frame 35, having a first end 36 and a second opposite end 37, is attached rotatably to the first end 31 of second support frame 30. Thigh frame 35 has a connector 39 at the second opposite end 37 of thigh frame 35. A rectangular calf frame 40, having a first end 41 and a second opposite end 42, is attached rotatably to the second opposite end 37 of thigh frame 35 by means of hinges 38. A linear actuator 43, such as an electrically powered cylinder, is attached to connector 45 at the second opposite end 32 of second support frame 30. The linear actuator 43 has a piston 44 which is connected to connector 39 on the second opposite end 37 of thigh frame 35. The linear actuator 43, thus, connects second opposite end 32 of second support frame 30 to the second opposite end 37 of thigh frame 35. The linear actuator 43 raises and lowers the thigh frame 35 and the calf frame 40. Calf frame 40 is shown resting on calf frame supports 34. Heel frame 50 is connected to the second opposite end 42 of calf frame 40.

Figure 3:
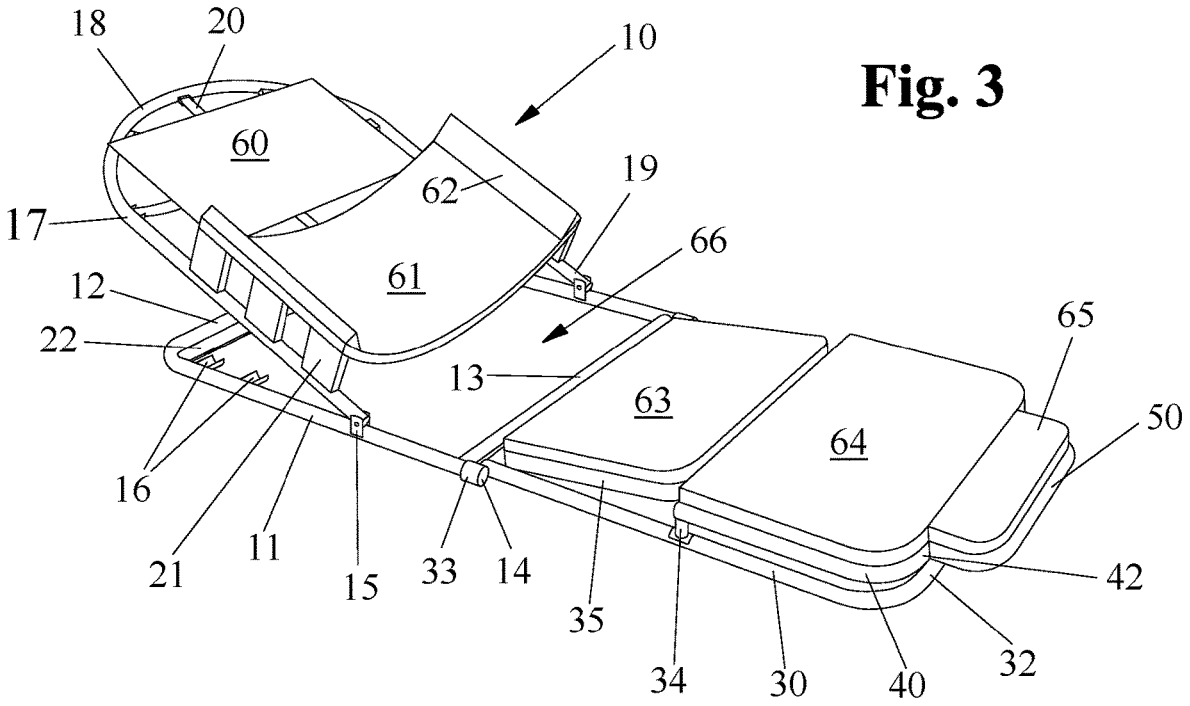
FIG. 3 shows a side perspective view of the first frame support connected to the second frame support, with a back frame rotated upwards by means of a support bar and a thigh frame and calf frame in a reclined position.

FIG. 3 shows the first frame support 11 connected to the second frame support 30 to form the body positioning bed frame assembly 10. The back frame 17 is rotated upwards about 30 degrees relative to the first frame support 11. The thigh frame 35 and the calf frame 40 are shown relatively adjacent to the second opposite frame support 30. A pillow 60 is shown placed on the head support 20. A back and shoulder pad 61 is shown placed on the curvilinear back supports 21. Wedge pads 62 may be used with the back and shoulder pad 61. A thigh pad 63 is shown placed on the thigh frame 35. A calf pad 64 is shown placed on the calf frame 40. A heel pad 65 is shown placed on the heel frame 50. There is a space 66 between the back frame 17 and the thigh frame 35 so that the body of a user is supported mainly by the back and legs while the hips and buttocks are not supported by the back frame 17 or the thigh frame 35. The hips and buttocks can, thus, be "wedged" into the space 66.

Figure 4:
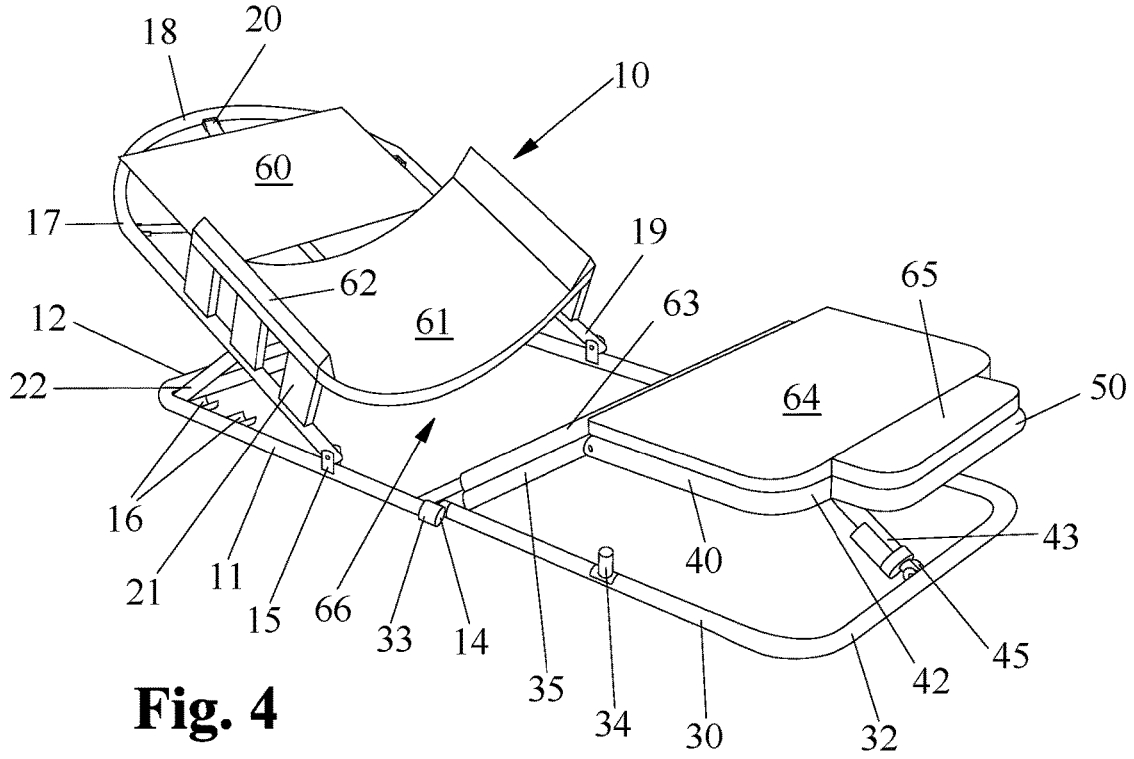
FIG. 4 shows the body positioning bed frame assembly of FIG. 3 with the thigh frame and calf frame rotated upwards by a linear actuator.
Figure 5:
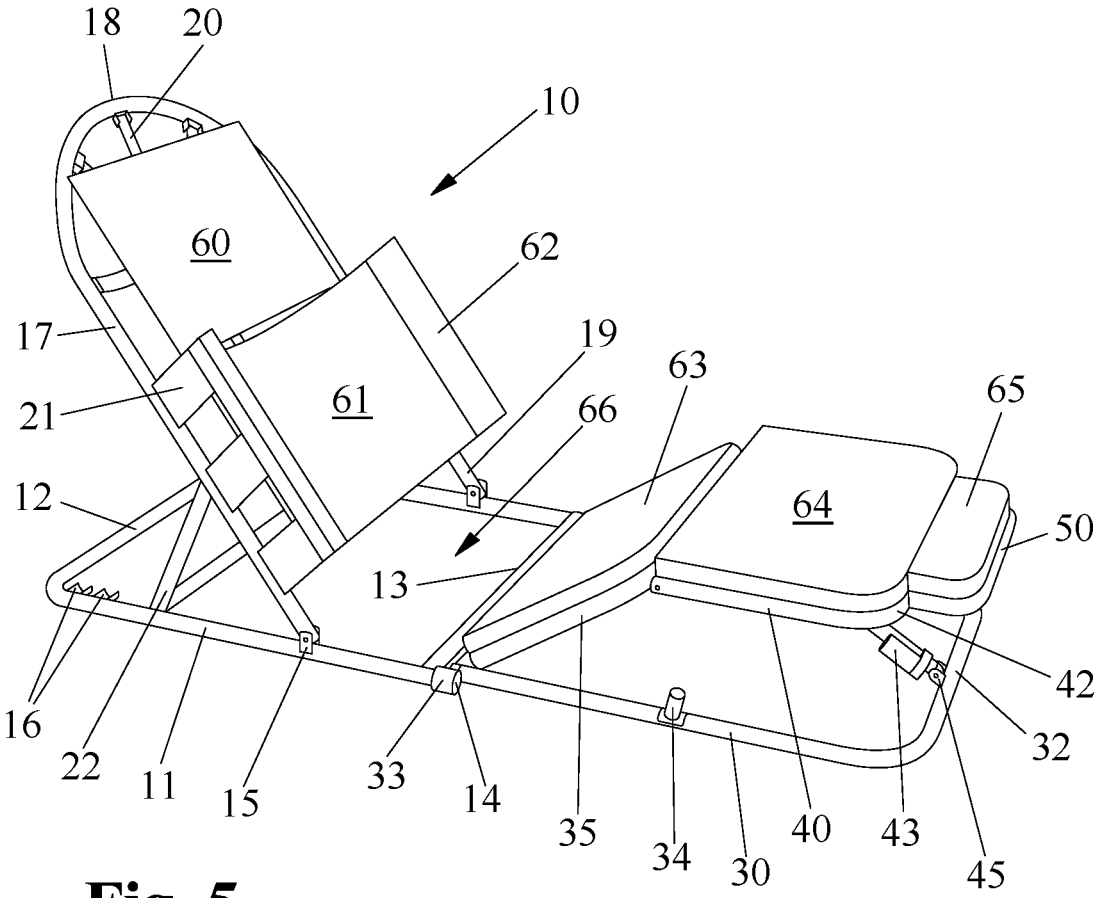
FIG. 5 shows the body positioning bed frame assembly of FIG. 4 with back frame rotated further upwards by means of the support bar.

FIG. 4 shows the body positioning bed frame assembly 10 with the thigh frame 35 and calf frame 40 also rotated upwards by the linear actuator. The thigh frame 35 is rotated about 30 degrees relative to the second frame support 30. The calf frame 40 is hinged to maintain the calf frame 40 approximately parallel to the second frame support 30 as the thigh frame 35 is rotated upward and downward. FIG. 5 shows the back frame 17 rotated upwards further to about 45 degrees relative to the first frame support 11. The body positioning bed frame assembly 10 can also be made completely flat (not shown).

Figure 6:
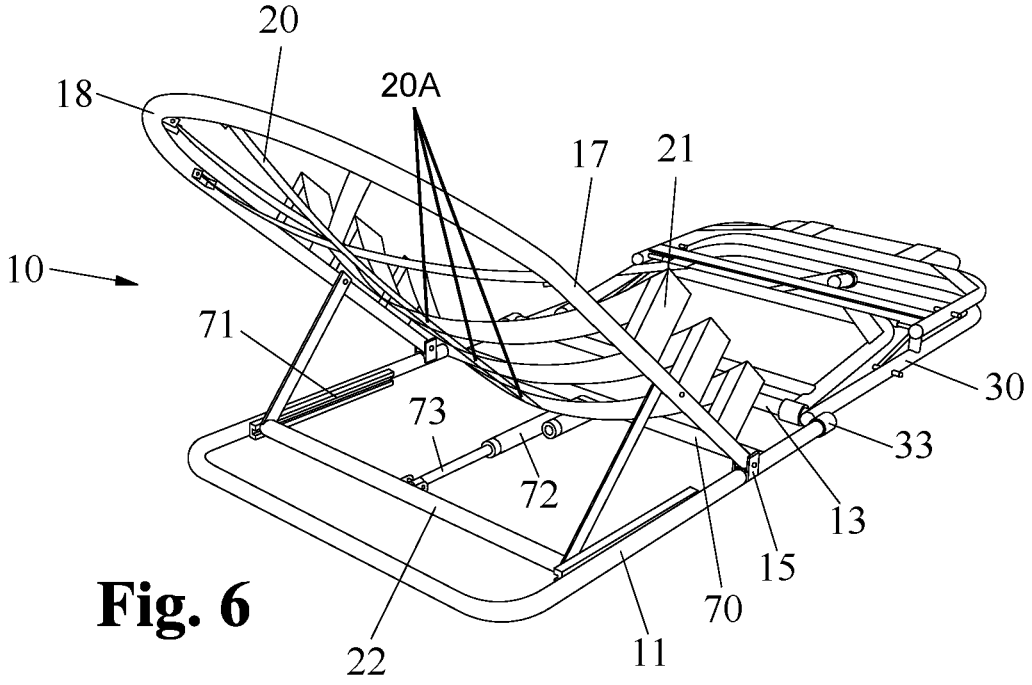
FIG. 6 shows a front perspective view of an alternate embodiment of the body positioning bed frame assembly with the back frame rotated upwards by action of a linear actuator.

FIG. 6 shows an alternate embodiment of the first frame support 11 which has a linear actuator support bar 70 positioned near the second opposite end 13 of first frame support 11. The rectangular lift support bar 22 is configured to ride on rails 71 attached to first frame support 11. A linear actuator 72 is positioned between the linear actuator support bar 70 and the rectangular lift support bar 22, with one end attached to the linear actuator support bar 70 and an opposite end attached to the rectangular lift support bar 22. As a piston 73 of the linear actuator 72 moves in and out of the linear actuator 72, it raises and lowers the U-shaped back frame 17.

As illustrated in FIGS. 1 and 6, certain embodiments of the body positioning bedframe have a curvilinear back support 21 that is threaded through a plurality of pockets 20A of the head support 20, wherein said plurality of pockets 20A are located on a strap of said head support 20, wherein said strap extends from a top end of said back frame 17 to a bottom end of said back frame 17 and is generally perpendicular to said curvilinear back support 21.

The body positioning bed frame assembly provides for positioning the torso of the body to variable angulation, with adjustments for comfort. The device allows for an adjustable convexity in the back that will maintain the shoulders in an anterior position. The legs can be elevated to shift the fulcrum of weight to the hips and buttocks, such as to "wedge" the body and avoid excess motion during sleep. The torso can be rotated upwards for 10 to 90 degrees which can be maintained by shifting weight to the hips and buttocks. The patient can be "wedged" between the back frame and the thigh frame in a comfortable position that is maintained through a full night, where elevation of the torso decreases pain, aids breathing, and assists in aspiration prophylaxis. The body positioning frame is foldable, lightweight, and has a frame that allows for portability to other sites, making patients more mobile and comfortable at the same time.

While there is described herein certain specific embodiments of the present invention, it will be manifest to those skilled in the art that various modifications may be made without departing from the spirit and scope of the invention as hereinafter claimed and that the invention is not limited to the particular forms herein described. All illustrations of the drawings are for the purpose of describing selected versions of the present invention and are not intended to limit the scope of the present invention.

The invention claimed is:

1. A portable body positioning assembly comprising:

a first support frame directly attached to a second support frame, wherein said first support frame is formed by a first u-shaped section and a first crossbar, wherein said second support frame is formed by a second u-shaped section and a second crossbar, wherein said first support frame and said second support frame are in a single plane, a back frame directly and rotatably attached to said first support frame and having a head support and curvilinear back support, wherein said curvilinear back support is threaded through a plurality of pockets of said head support, wherein said plurality of pockets are located on a strap of said head support, wherein said strap extends from a top end of said back frame to a bottom end of said back frame and is generally perpendicular to said curvilinear back support, wherein a back and shoulder pad of said curvilinear back support provides a convex surface operable to support shoulders of a user supported within said back frame, a thigh frame directly and rotatably attached to said second support frame, wherein a thigh pad of said thigh frame provides a surface operable to support thighs of said user, a calf frame rotatably attached to said thigh frame, and a lift support bar configured to support said back frame at an angle to said first support frame, wherein said back frame and said thigh frame are positioned in a spaced relation to form a space between said back frame and said thigh frame such that said back frame in combination with said back and shoulder pad supports a user's upper body, said thigh frame in combination with said thigh pad supports said thighs of said user, wherein hips and buttocks of said user are wedged between said back and shoulder pad and said thigh pad, wherein said hips and buttocks of said user are not in contact with said back and shoulder pad and said thigh pad.

2. The portable body positioning assembly of claim 1, wherein said curvilinear back support is adjustable.

3. The portable body positioning assembly of claim 1, further comprising a linear actuator configured to raise and lower said thigh frame and said calf frame.

4. The portable body positioning assembly of claim 1, wherein said second support frame has a first end and an opposing second end, wherein said thigh frame has a first end and an opposing second end, wherein said first end of said thigh frame is rotatably attached to said second support frame at said first end of said second support frame, wherein said first end of said thigh frame and said first end of said second support frame are both adjacent to said space between said back frame and said thigh frame, wherein a linear actuator is rotatably attached to said opposing second end of said thigh frame at one end of said linear actuator and rotatably attached to said opposing second end of said second support frame at an opposing end of said linear actuator.

5. The portable body positioning assembly of claim 4, wherein said calf frame is rotatably attached to said opposing second end of said thigh frame.

6. The portable body positioning assembly of claim 1, wherein said lift support bar is rotatably attached to said back frame and operable to adjustably engage said first support frame and thereby support said back frame at an angle to said first support frame.

7. The portable body positioning assembly of claim 1, further comprising a heel frame attached to said calf frame.

8. The portable body positioning assembly of claim 1, further comprising a connector, wherein said first support frame and second support frame are removably attached via said connector.

9. The portable body positioning assembly of claim 1, wherein said lift support bar is slideably attached to said first support frame via a rail.

10. A portable body positioning assembly, comprising: a first support frame having rails and a linear actuator support bar, wherein said first support frame is formed by a first u-shaped section and a first crossbar, wherein said first u-shaped section and said first crossbar are in a single plane, wherein said rails and said linear actuator support bar are connected to said first u-shaped section, wherein said linear actuator support bar is located at a bottom end of said first support frame, a back frame directly and rotatably attached to said first support frame and having a curvilinear back support, wherein a lift support bar rotatably attached to said back frame and slideably attached to said rails supports said back frame at an angle to said first support frame, wherein a first linear actuator having a first end attached to said linear actuator support bar and a second end attached to said lift support bar raises and lowers said back frame, a second support frame directly attached to said first support frame, wherein said second support frame is formed by a second u-shaped section and a second crossbar, wherein second u-shaped section and said second crossbar are in said single plane, wherein said rails and said linear actuator support bar are connected to said second u-shaped section, a thigh frame directly and rotatably attached to said second support frame, wherein a second linear actuator having said first end attached to said second support frame and said second end attached to said thigh frame raises and lowers said thigh frame, and a calf frame rotatably attached to said thigh frame via, hinges, wherein movement of said thigh frame by said second linear actuator causes concurrent movement of said calf frame about said hinges, wherein said concurrent movement about said hinges causes an angle created between an upper surface of said calf frame and said thigh frame to become more obtuse, wherein said back frame and said thigh frame are positioned in a spaced relation to form a space between said back frame and said thigh frame such that said back frame supports an upper body of a user, said thigh frame in combination with said calf frame supports legs of said user, wherein hips and buttocks of said user are positioned between said back frame and said thigh frame and not supported, the portable body positioning assembly further comprising a head support connected to said back frame, wherein said curvilinear back support is threaded through a plurality of pockets of said head support, wherein said plurality of pockets are located on a strap of said head support, wherein said strap extends from a top end of said back frame to a bottom end of said back frame and is generally perpendicular to said curvilinear back support.

11. The portable body positioning assembly of claim 10, wherein said curvilinear back support is adjustable.

12. The portable body positioning assembly of claim 10, further comprising a heel frame attached to said calf frame.

13. The portable body positioning assembly of claim 10, further comprising a connector, wherein said first support frame and said second support frame are removably attached via said connector.

* * * * *